US007213403B2

(12) United States Patent
Maier-Laxhuber et al.

(10) Patent No.: US 7,213,403 B2
(45) Date of Patent: May 8, 2007

(54) COOLING CONTAINER WITH AN ADSORPTION COOLING APPARATUS

(75) Inventors: Peter Maier-Laxhuber, Pfaffenhofen (DE); Andreas Becky, Ottobrunn (DE); Reiner Wörz, Reichertshausen (DE); Gert Richter, Unterschleissheim/Riedmoos (DE); Norbert Weinzierl, Freising (DE)

(73) Assignee: ZEO-TECH Zeolith-Technologie GmbH, Unterschleissheim (DE)

( * ) Notice: Subject to any disclaimer, the term of this patent is extended or adjusted under 35 U.S.C. 154(b) by 0 days.

(21) Appl. No.: 10/764,926

(22) Filed: Jan. 26, 2004

(65) Prior Publication Data

US 2004/0211215 A1 Oct. 28, 2004

(30) Foreign Application Priority Data

Jan. 28, 2003 (DE) ..... 103 03 292

(51) Int. Cl.
*F25B 15/16* (2006.01)

(52) U.S. Cl. ..... 62/109; 62/480

(58) Field of Classification Search ..... 62/479, 62/480, 481, 478, 109
See application file for complete search history.

(56) References Cited

U.S. PATENT DOCUMENTS 4,479,364 A 10/1984 Maier-Laxhuber
4,660,629 A 4/1987 Maier-Laxhuber et al.
4,674,563 A 6/1987 Maier-Laxhuber et al.
4,752,310 A 6/1988 Maier-Laxhuber et al.
4,802,341 A 2/1989 Maier-Laxhuber et al.
4,924,676 A 5/1990 Maier-Laxhuber et al.
4,956,977 A 9/1990 Maier-Laxhuber et al.
5,038,581 A 8/1991 Maier-Laxhuber et al.
5,050,403 A 9/1991 Maier-Laxhuber
5,054,544 A 10/1991 Maier-Laxhuber et al.
5,207,073 A 5/1993 Maier-Laxhuber et al.
5,359,861 A 11/1994 Maier-Laxhuber et al.
5,404,728 A 4/1995 Maier-Laxhuber
5,415,012 A 5/1995 Maier-Laxhuber et al.
5,440,896 A 8/1995 Maier-Laxhuber et al.
5,477,706 A * 12/1995 Kirol et al. ..... 62/480
5,482,541 A 1/1996 Maier-Laxhuber et al.
5,518,069 A 5/1996 Maier-Laxhuber et al.
5,664,427 A * 9/1997 Rockenfeller et al. ..... 62/112
5,666,819 A * 9/1997 Rockenfeller et al. ..... 62/480
5,816,069 A 10/1998 Ebbeson
5,992,168 A * 11/1999 Pfister et al. ..... 62/259.2
6,305,186 B1 * 10/2001 Py et al. ..... 62/480
6,349,553 B1 * 2/2002 Pfister et al. ..... 62/259.2
6,349,560 B1 2/2002 Maier-Laxhuber et al.
6,378,326 B2 4/2002 Maier-Laxhuber et al.

(Continued)

*Primary Examiner*—Mohammad M. Ali
(74) *Attorney, Agent, or Firm*—Hoffmann & Baron, LLP

(57) ABSTRACT

A sorption cooling apparatus for cooling a thermally insulated cooling container 1, with a sorber container 5 containing a sorber material 7 which, during a sorption phase, sorbs a working fluid which evaporates in an evaporator 2 that is disposed in the interior chamber of cooling container 1 and with a valve 4 between sorber container 5 and evaporator 2, which valve can be shut off and which can stop the flow of the working fluid steam, with an evaporator blower 12 being disposed along evaporator 2, which evaporator blower passes an air stream over the evaporator, and with a sorber blower 10 being disposed along sorber container 5, which sorber blower can circulate air around the container containing the sorbent material.

20 Claims, 1 Drawing Sheet

U.S. PATENT DOCUMENTS 6,412,295 B2 7/2002 Weiss et al.
6,701,724 B2 * 3/2004 Smith et al. ..... 62/106
6,824,592 B2 * 11/2004 Monzyk et al. ..... 96/4

* cited by examiner

COOLING CONTAINER WITH AN ADSORPTION COOLING APPARATUS

This application claims priority from Application No. DE 103 03 292.4, filed on Jan. 28, 2003.

FIELD OF THE INVENTION

The present invention relates to a cooling container with an adsorption cooling apparatus and a method for the operation thereof.

BACKGROUND OF THE INVENTION

Adsorption devices are apparatuses in which a solid sorbent material sorbs a second material, the working fluid, that boils at a lower temperature in the form of steam while liberating heat (sorption phase). In the course of this process, the working fluid evaporates in an evaporator while absorbing heat. After the sorbent material is saturated, it can be desorbed by means of heat input (desorption phase). In the course of this process, the working fluid evaporates from the adsorbing agent. The working fluid steam can be recondensed and can subsequently evaporate again in the evaporator.

Adsorption apparatuses for cooling with solid sorbent materials are known from EP 0 368 111 and from DE-OS 34 25 419. Sorber containers filled with sorbent materials draw off the working fluid steam which develops in an evaporator and sorb it while liberating heat. This heat of sorption must be eliminated from the sorbent materials with which the sorber container is filled. The cooling apparatuses can be used for cooling food and for keeping it warm in thermally insulated boxes.

The sorption cooling system known from EP 0 368 111 comprises a portable cooling unit and a stationary charging station that can be separated from said cooling unit. The cooling unit comprises a sorption container filled with a solid sorbent material and an evaporator which contains a liquid working material and a heat exchanger that is embedded therein. The evaporator and the sorption container are connected to each other by means of a steam line that can be shut off. Liquid media which are cooled to the temperature level desired by the temperature-controlled opening and shutting off of the shut-off device flow through a heat exchanger that is embedded in the evaporator. Once the sorbent material is saturated with the working fluid, it can be heated in the charging station. The steam draining from the working fluid is recondensed in the evaporator. The heat of condensation is dissipated by cooling water which must flow through the embedded heat exchanger.

The problem to be solved by the present invention is to make available a cooling container with an adsorption cooling apparatus which cools the container content over a relatively long period of time to a low temperature level without an external energy source and the cooling energy of which can be charged at a later time and can subsequently be stored without loss for a random length of time.

SUMMARY OF THE INVENTION

The adsorption cooling apparatus according to the present invention thus comprises a sorbent material inside a sorber container, a valve, and a liquid working material inside the evaporator. During the desorption phase, heat is added to the sorbent material and abstracted during the sorption phase. During the sorption phase, heat of evaporation is added to the working fluid and during the desorption phase, heat of condensation is abstracted. The quantities of heat are transferred to air streams which are transported by means of electrically operated blowers across appropriately designed heated surfaces.

During the desorption phase, working fluid steam is desorbed. This steam flows through the opened or self-opening valve to the evaporator where it condenses out. The transported quantities of air should be large enough to ensure that the heat of condensation can be carried off at a relatively low temperature level. At the end of this phase, the heat input into the sorbent material is stopped. The desorption of additional working fluid steam ends. Closing the valve prevents the working fluid steam from flowing back. The desorbed working fluid is subsequently present in liquid form in the evaporator. In this ready-to-use state, the adsorption cooling apparatus can be stored for a random length of time.

It is useful to line the sorber container with a temperature-stable thermal insulation so as to minimize heat losses to the environment during the desorption process.

To initiate the adsorption phase, the valve is opened. Working fluid steam can now flow from the evaporator into the sorber container and be exothermally sorbed by the sorbent material. Because of the evaporation of a partial quantity, the quantity of working fluid in the evaporator as well as the air stream passing the heat exchanger are cooled. To generate the maximum cooling energy, the sorbent material must be able to dissipate its heat of sorption in a heat exchanger to the environment. An especially intensive cooling effect is obtained when the sorber container has a sufficiently large heat exchanger surface for the air stream that circulates around said sorber container. It is useful if the sorbent material can be cooled to ambient temperatures so as to be able to evaporate the maximum quantity of the working fluid at sufficiently low temperatures of evaporation.

The sorbent material used according to the present invention is zeolite. Per kilogram of zeolite, an adsorption cooling apparatus can store refrigeration energy corresponding to approximately 130 watt-hours without losses and over a random length of time. After the valve is opened, this cooling energy is immediately available. Zeolite is a crystalline mineral which has a regular lattice structure of silicon and aluminum oxides. This lattice structure contains cavities in which water molecules can be sorbed while releasing heat. Within the lattice structure, the water molecules are exposed to strong field forces, the strength of which depends on the quantity of water already contained in the lattice structure and on the temperature of the zeolite. For practical applications, up to 25 grams of water per 100 grams of zeolite can be sorbed. Zeolites are solid materials without interfering heat expansion during the sorption and desorption reaction. The lattice structure is openly accessible on all sides for water vapor molecules. Therefore, adsorption devices can be used in any situation.

It is, however, also possible to use other sorbent material combinations in which the sorbent material is solid and remains solid during the sorption reaction. Solid sorbent materials, however, are marked by a low thermal conduction and an unsatisfactory heat transfer. Since the heat transfer from an air stream to the sorbent material heat exchanger is also in approximately the same order of magnitude, it is recommended that heat exchangers without ribs, for example, cylindrical, plate or tubular geometries, be used. Since especially zeolite granules have a low thermal conductivity, the sorber containers should be designed to ensure that the average thermal conduction path for the quantities of heat transformed does not exceed 2 cm.

A few solid sorbent materials, such as zeolite, are sufficiently stable to support excessive external pressures without a change in volume even if the container walls are thin. Additional reinforcements or heat exchanger surfaces with thick walls are therefore not needed. Since the sorption device is under a vacuum when water is used as the working fluid and since no gases should enter the system during its operating time, vacuum sealed components should be used. For manual actuation of the valve, lead-throughs that are sealed by means of metal bellows have proven to be useful.

For an efficient operation, zeolite temperatures of 250° C. to 350° C. for the regeneration phase and 30° C. to 50° C. for the sorption phase are recommended. It is of special advantage if the regeneration is carried out by means of a hot air stream at air temperatures higher than 300° C. If the zeolite filling is present in a thin layer, the regeneration can be concluded within one hour. Care should be taken to ensure that the condensation temperatures remain under 100° C. by ensuring that a sufficient air stream circulates around the evaporator. At higher temperatures, the vapor pressure inside the container would be higher than the air pressure outside, which would necessarily cause container structures with thin walls to be inflated.

The use of water as the working fluid makes it possible to reduce the control mechanism design to a minimum. On evaporation of water under a vacuum, the surface of the water cools down to 0° C. and freezes to form ice as the evaporation continues. The layer of ice can be advantageously used to control the air temperature. When only a small quantity of heat is emitted from the air stream, the layer of ice increases, if the quantity of heat emitted is high, the layer of ice melts. If the boiling temperature of the liquid is to be lowered to below 0° C., it is also possible to mix substances that lower the freezing point to the aqueous working liquid.

The adsorption cooling apparatus is especially suitable for mobile use for which no external energy supply is available. According to the present invention, the energy required to operate the blower is stored in an accumulator. During the desorption phase, this accumulator can be recharged by means of a charging device. To save electrical energy, the blowers are only operated when the cooling temperature desired inside the cooling container has been exceeded. Once the cooling temperature has been reached or falls below the desired cooling temperature, the blower which blows air over the sorber container is also turned off.

The temperatures of the air streams exiting from the evaporator heat exchanger can be controlled by means of known methods via a throttling function of the valve.

According to the present invention, the air temperature can also be controlled independently of the throttle function. For example, to lower the exit temperature of the air stream exiting from the evaporator, the air stream through the sorption heat exchanger can be increased. Since the thermodynamic equilibrium is invariably established when the valve is open, a decrease of the sorbent fluid temperature will entail a decrease of the temperature of evaporation. The air stream exiting from the evaporator therefore necessarily turns colder.

It is also useful to design the valve as a check valve. In this case, the regeneration can even be carried out when the valve is closed. To condense in the evaporator, the working fluid steam flowing off the sorbent material automatically opens the check valve. Since the valve does not need to be opened for the desorption phase, it also does not need to be actively closed at the end of the regeneration phase. This a considerable advantage ensures accurate and simple handling.

A preferred form of the adsorption cooling apparatus according to the present invention, as well as other embodiments, objects, features and advantages of this invention will be apparent from the following detailed description of illustrative embodiments thereof, which is to be read in conjunction with the accompanying drawings.

BRIEF DESCRIPTION OF THE DRAWING

The drawing in FIG. 1 shows a diagrammatic sectional view of a cooling container with an adsorption cooling apparatus according to the present invention.

DETAILED DESCRIPTION OF THE PREFERRED EMBODIMENTS

Figure 1:
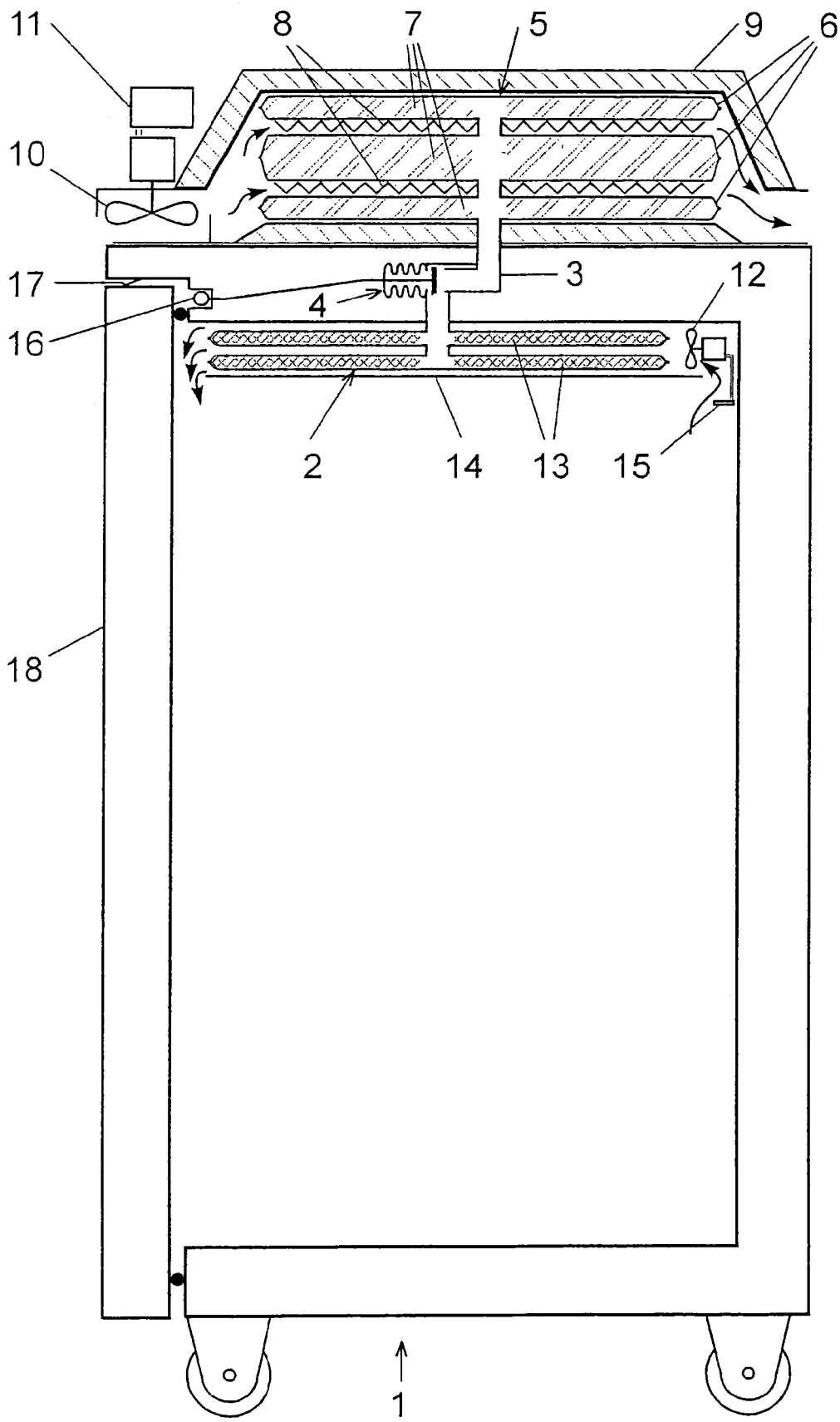

On the ceiling of the inside of a traveling insulated cooling container 1, an evaporator 2 is located, which evaporator is connected to a sorber container 5 via a working fluid steam line 3 and a check valve 4. Both sorber container 5 and evaporator 2 are plate like heat exchanger configurations. The sorber heat exchanger comprises three plates 6 which contain the sorbent material zeolite 7. The zeolite filling is introduced in the form of prefabricated molded plates into which the distribution structure required for the flow of the working fluid steam is incorporated. Between plates 6, two electrical heating elements 8 are located, via which the air gap between plates 6 and thus plates 6 as such can be heated. Sorber container 5 is enclosed in a thermally insulated flow cabinet 9 through which a sorber blower 10 transports ambient air after the desorption phase and, at times, during the sorption phase. Sorber blower 10 as well as an evaporator blower 12 are fed by an accumulator 11 during the sorption phase. During the sorption phase, evaporator blower 12 circulates the air to be cooled inside cooling container 1 along the paths marked by arrows over evaporator 2 which is screened against the internal chamber by means of an air baffle plate 14. A temperature sensor 15 controls the temperature of the internal chamber. Evaporator 2 is constructed of two flat profile plates 13 in the inside chamber of which supporting elements and a non-woven fabric that distributes the working fluid, water, ensure that the profile plates 13 do not implode and that the working fluid can evaporate evenly. A safety device 17 signals to a control (not shown) whether door 18 is open or closed.

The operation of the cooling container can be divided into a desorption phase and a sorption phase.

During the desorption phase, the two electrical heating elements 8 are operating. As the zeolite temperatures increase, more and more water vapor evaporates from zeolite 7. The increasing vapor pressure opens check valve 4, and the working fluid steam enters evaporator 2 where it condenses. The heat of condensation is dissipated to the air stream which is transported by evaporator blower 12 over profile plates 13. To ensure that the temperature inside the cooling container does not increase too much, door 18 of the container must be open during the desorption phase. This is controlled by safety device 17. If the door is closed and temperature sensor 15 senses that the temperature in the container has exceeded an upper threshold value, electrical heating elements 8 are safety-disconnected or turned off. During the desorption phase, cooling container 1 is connected to the stationary power supply via which electrical heating elements 8 are supplied. At the same time, accumulator 11 is charged. At the end of the desorption phase, heating of the zeolite filling is stopped and sorber blower 10 is turned on. As a result, sorber container 5 cools down to ambient temperature. But steam from evaporator 2 cannot flow back through the automatically closed check valve 4.

Only in the sorption phase can this steam flow back when valve 4 is opened by valve actuating element 16. Now evaporator 2 cools down since the working fluid, water, evaporates. The steam flows into sorber container 5 where it is sorbed by zeolite 7 while releasing heat. This heat of sorption is dissipated into the ambient air by sorber blower 10. Since during the sorption phase, cooling container 1 is generally not connected to the electrical power system, both sorber blower 10 and evaporator blower 12 are operated via accumulator 11. To save electrical energy, both sorber blower 10 and evaporator blower 12 are stopped as soon as temperature sensor 15 senses that the internal temperature in the cooling container has fallen below the preset temperature in the cooling chamber. Thus, it is ensured that especially at the beginning of the cooling phase during which cooling container 5 often must also be preliminarily cooled, the maximum cooling energy is available. Check valve 4 can remain open until cooling container 1 is again connected to the electrical power supply so that it can be recharged.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A sorption cooling apparatus comprising:

a thermally insulated cooling container defining an inner chamber for containing an item to be cooled by the sorption cooling apparatus and including a door for opening at least during a desorption phase and closing said inner chamber at other times;

a sorber container disposed outside the cooling container, said sorber container containing a sorbent material for sorbing a working fluid during a sorption phase;

an evaporator disposed inside said inner chamber of the cooling container, said working fluid evaporating to a working fluid gas in said evaporator during a desorption phase;

a valve connected between said sorber container and said evaporator, said valve being adapted to be shut off for stopping a flow of said working fluid gas;

an evaporator blower disposed adjacent said evaporator in said inner chamber of said cooling container for passing an air stream over said evaporator; and a sorber blower disposed adjacent said sorber container for circulating air around said sorber container containing said sorbent material.

2. A sorption cooling apparatus as defined in claim 1, wherein at least one of said sorber container and said evaporator includes surfaces shaped like plates and are adapted for exchanging heat with a stream of air.

3. A sorption cooling apparatus as defined in claim 1, wherein said valve is a control valve for controlling a temperature of said evaporator by means of throttling a stream of working fluid gas.

4. A sorption cooling apparatus as defined in claim 1, wherein said sorber container is adapted to ensure that a maximum heat conduction path to a surface of the cooling container is less than 2 cm.

5. A sorption cooling apparatus as defined in claim 1, further comprising an electrical heating system dedicated to said sorber container.

6. A sorption cooling apparatus as defined in claim 1, further comprising an electrical accumulator for supplying electricity to said sorber blower and said evaporator blower.

7. A sorption cooling apparatus as defined in claim 1, wherein said sorbent material comprises zeolite and said working fluid comprises water.

8. A sorption cooling apparatus as claimed in claim 5, further comprising a temperature sensor coupled to said evaporator for turning off said electrical heating system of said sorber container once a preselected threshold temperature has been exceeded.

9. A sorption cooling apparatus as defined in claim 1, wherein said cooling container includes an upper outer surface and an inner ceiling inside said inner chamber below said upper outer surface, said sorber container being disposed on said upper outer surface and said evaporator being disposed on said inner ceiling.

10. A sorption cooling apparatus as defined in claim 1, further comprising an air baffle plate disposed adjacent said evaporator for screening said evaporator against said inner chamber of said cooling container.

11. A sorption cooling apparatus for cooling a thermally insulated cooling container comprising:

a sorber container containing a sorbent material for sorbing a working fluid during a sorption phase;

an evaporator disposed inside the cooling container, said working fluid evaporating to a working fluid gas in said evaporator during a desorption phase;

a valve connected between said sorber container and said evaporator, said valve being adapted to be shut off for stopping a flow of said working fluid gas;

an evaporator blower disposed adjacent said evaporator for passing an air stream over said evaporator;

a sorber blower disposed adjacent said sorber container for circulating air around said sorber container containing said sorbent material; and a safety device for preventing the desorption phase from taking place when a door of the cooling container is closed.

12. A method for cooling a thermally insulated cooling container with a sorption cooling apparatus, the method comprising the steps of:

providing a sorber container outside the cooling container;

providing an evaporator inside an inner chamber of the cooling container, said inner chamber being adapted for containing an item to be cooled by the sorption cooling apparatus;

sorbing a working fluid with a sorbent material contained in the sorber container of the sorption cooling apparatus during a sorption phase;

evaporating said working fluid to a working fluid gas in the evaporator of the sorption cooling apparatus during a desorption phase, said evaporator being disposed inside the cooling container;

controlling a flow of working fluid gas between said sorber container and said evaporator with a valve of the sorption cooling apparatus; and passing an air stream from outside said cooling container over said evaporator with an evaporator blower of the sorption cooling apparatus during said desorption phase by opening a door of the cooling container.

13. A method for cooling a thermally insulated cooling container as defined in claim 12, further comprising the step of controlling an internal temperature of the cooling container during the sorption phase by operating said evaporator blower in a switching mode and opening said valve.

14. A method for cooling a thermally insulated cooling container as defined in claim 12, further comprising the step of operating said sorber blower in a switching mode synchronously with said evaporator blower.

15. A method for cooling a thermally insulated cooling container as defined in claim 12, further comprising the steps of:

supplying electricity to said sorber blower and said evaporator blower with an electrical accumulator of the sorption cooling apparatus; and charging said electrical accumulator during the desorption phase.

16. A method for cooling a thermally insulated cooling container as defined in claim 12, wherein said working fluid is condensed in said evaporator and heat of condensation from said working fluid is released to said air stream generated by said evaporator blower during the desorption phase.

17. A method for cooling a thermally insulated cooling container as defined in claim 12, further comprising the step of opening a door of the cooling container during the desorption phase, wherein an exchange of air with ambient air takes place.

18. A method for cooling a thermally insulated cooling container as defined in claim 12, wherein said cooling container includes a door for opening and closing said inner chamber.

19. A method for cooling a thermally insulated cooling container with a sorption cooling apparatus comprising the steps of:

sorbing a working fluid with a sorbent material contained in a sorber container of the sorption cooling apparatus during a sorption phase, said sorber container being disposed on an upper outer surface of the cooling container;

evaporating said working fluid to a working fluid gas in an evaporator of the sorption cooling apparatus during a desorption phase, said evaporator being disposed on a ceiling inside the cooling container below said sorber container;

controlling a flow of working fluid gas between said sorber container and said evaporator with a valve of the sorption cooling apparatus;

passing an air stream over said evaporator with an evaporator blower of the sorption cooling apparatus; and circulating air around said sorbent container with a sorber blower of the sorption cooling apparatus, wherein the sorption phase is at least three times longer than the desorption phase.

20. A method for cooling a thermally insulated cooling container with a sorption cooling apparatus comprising the steps of:

sorbing a working fluid with a sorbent material contained in a sorber container of the sorption cooling apparatus during a sorption phase, said sorber container being disposed on an upper outer surface of the cooling container;

evaporating said working fluid to a working fluid gas in an evaporator of the sorption cooling apparatus during a desorption phase, said evaporator being disposed on a ceiling inside the cooling container below said sorber container;

controlling a flow of working fluid gas between said sorber container and said evaporator with a valve of the sorption cooling apparatus;

passing an air stream over said evaporator with an evaporator blower of the sorption cooling apparatus; and circulating air around said sorbent container with a sorber blower of the sorption cooling apparatus; and setting the air temperature inside the cooling container between minus 20° C. and 0° C. during the sorption phase.

* * * * *